US006390174B1

(12) United States Patent
Bloch et al.

(10) Patent No.: US 6,390,174 B1
(45) Date of Patent: May 21, 2002

(54) METHOD OF EXTRACTING CASTINGS FROM MOULDS IN A MOULD-STRING PLANT, AND PLANT FOR USE IN CARRYING OUT THE METHOD

(75) Inventors: Anders C. Bloch, Helsinge; Jan Sørensen, Birkerød, both of (DK)

(73) Assignee: Georg Fischer Disa A/S (DK)

( * ) Notice: Subject to any disclaimer, the term of this patent is extended or adjusted under 35 U.S.C. 154(b) by 0 days.

(21) Appl. No.: 09/423,541

(22) PCT Filed: Mar. 16, 1998

(86) PCT No.: PCT/DK98/00100

§ 371 Date: Nov. 12, 1999

§ 102(e) Date: Nov. 12, 1999

(87) PCT Pub. No.: WO98/51433

PCT Pub. Date: Nov. 19, 1998

(30) Foreign Application Priority Data

May 14, 1997 (DK) ..... 0554/97

(51) Int. Cl.[7] ..... B22D 29/04

(52) U.S. Cl. ..... 164/131; 164/344; 164/404

(58) Field of Search ..... 164/404, 401, 164/402, 403, 408, 344, 131

(56) References Cited

U.S. PATENT DOCUMENTS 1,059,668 A * 4/1913 Gatmann
3,545,531 A * 12/1970 Schaper ..... 164/408
3,563,302 A * 2/1971 Thevenin ..... 164/404
3,627,020 A 12/1971 Taccone
3,923,095 A * 12/1975 Jorgensne et al. ..... 164/404
4,082,135 A * 4/1978 Peterson et al. ..... 164/404
4,359,083 A 11/1982 Jacobsen
6,092,585 A * 7/2000 Larsen et al. ..... 164/130

FOREIGN PATENT DOCUMENTS

SU 783-766 6/1980

OTHER PUBLICATIONS

Patent Abstracts of Japan, vol. 7, No. 163, M–229 abstract of JP 58–68465 A (Shinto Kogyo K.K.), Apr. 23, 1983.

* cited by examiner

*Primary Examiner*—M. Alexandra Elve
*Assistant Examiner*—Len Tran
(74) *Attorney, Agent, or Firm*—Larson & Taylor, PLC

(57) ABSTRACT

In a method of extracting castings (1, 2, 3) from moulds in a mould-string plant, the downstream-most mould (1) is gripped by a robot gripper (9) and made to cooperate with an engagement member (14), the latter first penetrating into the mould adjacent the casting (4) and then pulling the latter away from the mould. By proceeding in this manner it is possible to achieve a reliable extraction using relatively simple equipment and procedures. Other types of engagement members could be suctions cups or electromagnets.

18 Claims, 2 Drawing Sheets

METHOD OF EXTRACTING CASTINGS FROM MOULDS IN A MOULD-STRING PLANT, AND PLANT FOR USE IN CARRYING OUT THE METHOD

FIELD OF THE INVENTION

The present invention relates to a method of extracting castings from moulds in the manner set forth in the preamble of claim 1.

BACKGROUND ART

Previous methods of the kind referred to above have normally been based upon the mould being smashed in a more or less rough fashion, such as being tumbled in a drum or dropped onto a vibrating conveyor.

Especially in the case of aluminium castings, this rough treatment of the mould may damage the castings. Attempts have been made to "save" aluminium castings by manually gripping them before they hit the conveyor, but—as will readily be appreciated by persons skilled in the foundry trade—such manual work is both strenuous and monotonous, as well as unhealthy due to the air in the extraction station being heavily dust-laden.

Attempts have also been made by using a robot with gripper arms, making the latter penetrate through the main body of each mould to engage the casting or castings. This method is costly, as a robot with ample "muscle power" is required. Further, this method is not suitable for extracting multiple castings, because the latter will offer a too high resistance to the penetration. Still further, the gripper arms must not be too thick, calling for a compromise between mechanical strength and penetrating ability.

DISCLOSURE OF THE INVENTION

It is the object of the present invention to provide a method of the kind referred to initially, with which it is possible to extract the castings from the moulds using less costly equipment and with reduced risk of damage to frail castings, and this object is achieved by proceeding in the manner set forth in the characterizing clause of claim 1. By so doing, the castings may be extracted by moving each mould with the casting or castings so as to bring the latter into engagement with the engagement member or members referred to, and then again moving the mould in a manner causing the engagement member or members to loosen and liberate the casting or castings from the mould. In the simplest manner, this could be achieved by means of a hook or hooks not having to penetrate through more of the mould body than superficial portions adjacent the castings, said hook or hooks then being used to pull the castings out of the part of the casting cavity formed in the downstream face of the mould. Obviously, relatively little force is needed for these steps, for which reason a less costly robot may be used.

The present invention also relates to an automated foundry plant for carrying out the method of the invention. This plant is of the kind set forth in the preamble of claim 12, and according to the invention, it also comprises the features set forth in the characterizing clause of this claim 12.

Further embodiments of the method and the plant, the effects of which—beyond what will be obvious to a skilled person—are explained in the following detailed part of the present description, are set forth in claims 2–11 and 13–18, respectively.

BRIEF DESCRIPTION OF THE DRAWINGS

In the following detailed part of the present description, the invention will be explained in more detail with reference to the exemplary embodiment of an automatic foundry plant according to the invention, shown in a highly simplified, diagrammatic manner in the drawings, of which

DESCRIPTION OF THE PREFERRED EMBODIMENT

Figure 1:
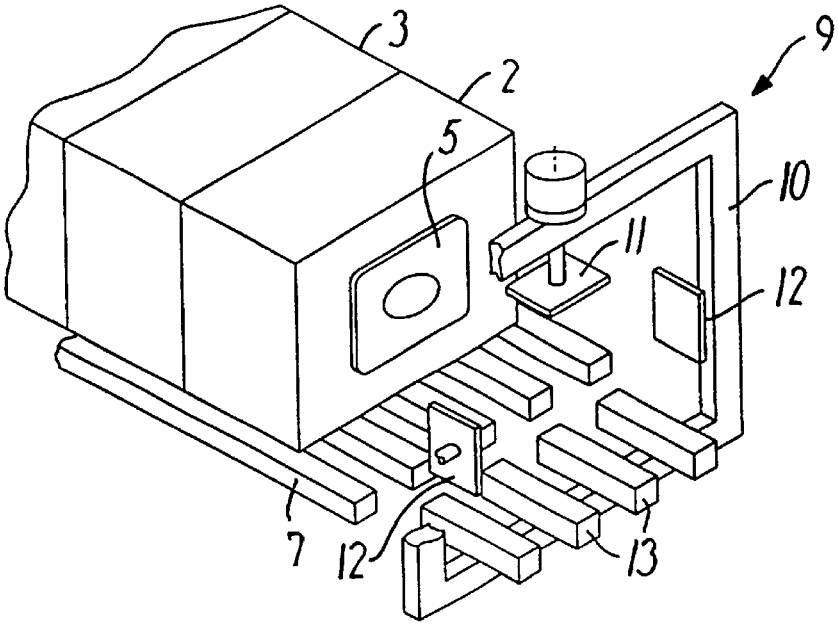
FIG. 1 is a perspective view showing the downstream end of a string of moulds carried and advanced on bars extending in the direction of movement, as well as a robot gripper for handling the moulds one by one.
Figure 2:
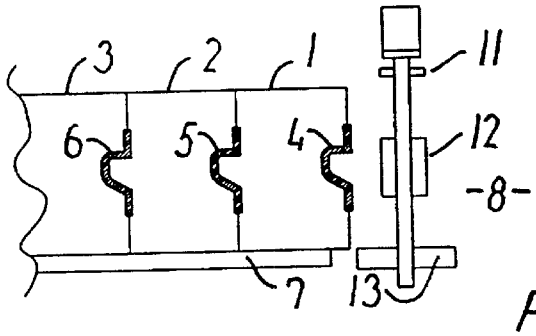
FIGS. 2–7 show the downstream end of a string of moulds, in which molten metal has previously been poured and then solidified prior to their arrival at said downstream end, showing successive steps during the extraction, using a robot, of a casting from the downstream-most mould.

FIG. 2 shows a string of moulds, of which only the "oldest" or downstream-most mould 1 and the next following moulds 2 and 3 are shown, carrying in their casting cavities castings 4, 5 and 6 respectively, of which only the downstream-most casting 4 is accessible, due to the preceding mould (not shown) having been removed in a previous step.

The string of moulds 1, 2, 3 etc. rests on a supporting arrangement consisting of a number of parallel bars 7. The bars 7 may be part of a "walking conveyor" comprising at least two sets of bars alternatively lifting and advancing the string of moulds from a pouring station (not shown), but they may also be a simple "table top", on which the string of moulds slides, being pushed by suitable means (not shown).

The extraction station 8, here simply the region immediately downstream of the "oldest" mould 1, comprises a robot gripper 9, in the exemplary embodiment shown comprising a rectangular frame 10, adapted to be carried and manipulated by a distal arm (not shown) on a robot (likewise not shown), being connected to the latter through a coupling part (also not shown) comprising the requisite mechanical, fluidic and/or electrical connections.

Figure 3:
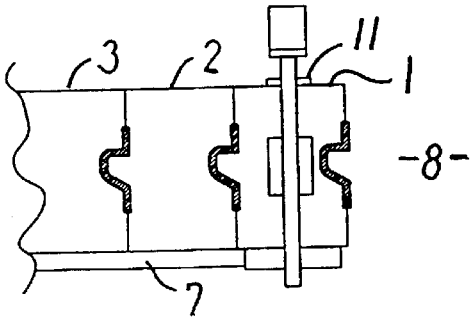
Figure 4:
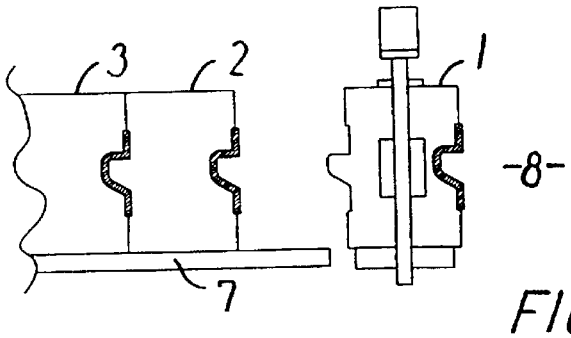

The robot gripper 9 comprises, secured to the frame 10, two pneumatically operated lateral pressure pads 12 adapted to grip a mould between them by pressing against the lateral faces of the mould, and further, a number of lifting bars 13 so placed and spaced, that they can be inserted longitudinally into the spaces between the bars 7 and then raised, so as to lift a mould free of the bars 7, after which the mould is moved into the extraction station 8, cf. the steps shown in FIGS. 2–4. An upper pressure pad 11 serves to press the mould against the lifting bars 13, so as to increase the force used to pull the downstream-most mould 1 free from the casting 5 in the next mould 2.

Figure 5:
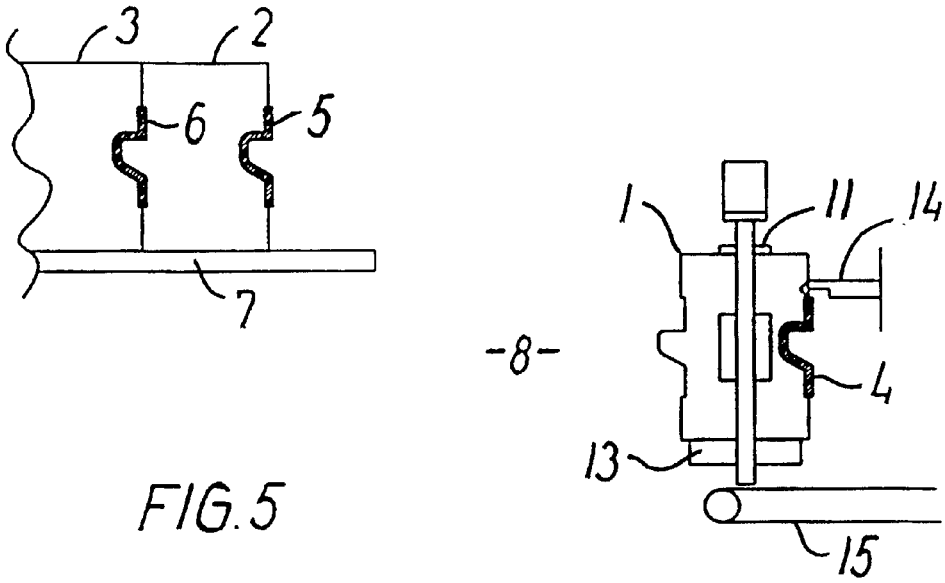
Figure 6:
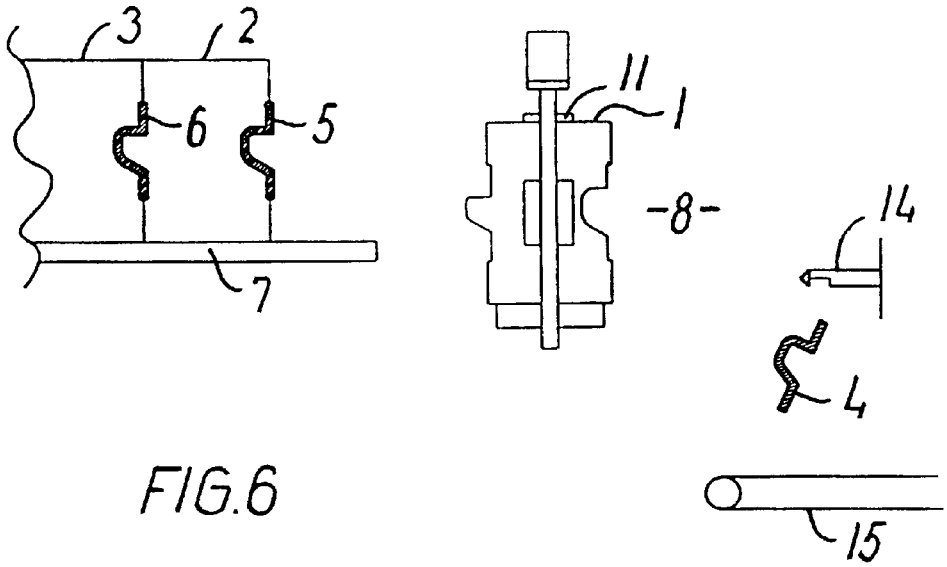

A further important feature of the extraction station is an engagement hook 14, of FIGS. 5 and 6.

In the exemplary embodiment shown, there is only one engagement hook (or only one for each casting in the case of a multiple-casting mould), and this hook is stationary, i.e. anchored to some stationary object (not shown). In other embodiments (not shown), the hook or hooks is/are movable, and if there are at least two hooks for each casting, they can also be arranged to cooperate like a pair of tongs or plies, so as to grip the casting firmly and hold it until it is deposited on e.g. a conveyor for transfer to a succeeding work station.

Now back to the exemplary embodiment shown in FIGS. 1–7: When, as shown in FIG. 4, the downstream-most mould 1 has been gripped by the robot gripper 9 and moved from the bars 7 into the extraction station 8, the gripper 9 is moved so as to cause the face of the mould 1, on which the casting 4 is situated, being carried by the part of the casting cavity formed in this face of the mould, into a position, of FIG. 5, in which the engagement hook 14 penetrates the mould material (normally compacted mould sand) superficially, i.e. only to the extent necessary for the hook to engage an upstream surface on the casting 4.

In the next step, shown in FIG. 6, the mould 1 is again moved away from the hook 14, which will then pull the casting 4 out of the casting cavity part concerned, after which the casting 4 falls down on a conveyor 15, on which it is carried to the next station (not shown) for further processing, if necessary.

Figure 7:
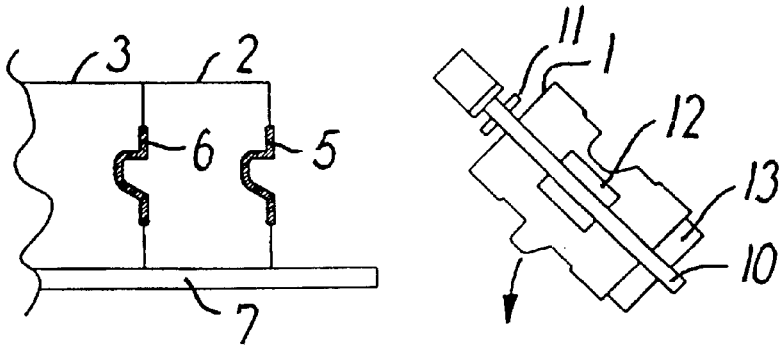

FIG. 7 shows the frame 10 in an inclined position with the pressure pads 11 and 12 disengaged from the mould 1, immediately before the latter slides down on the lifting bars 13 to fall onto a suitable conveyor (not shown) for recycling. When the frame 10 is free, it will be returned to the position shown in FIG. 2 in readiness for the next operating cycle.

Although not clearly evident from FIG. 6, the conveyor 15 may be placed at such a high level, e.g. by making it extend transversely to the plane of the drawing, that the height of fall for the casting 4 will be a minimum.

In the above-mentioned embodiment (not shown) having two or more engagement hooks cooperating in the manner of a pair of tongs,it is, of course, possible to arrange for the castings to be placed gently on e.g. a conveyor, so as to eliminate any risk of damage during this step.

In the exemplary embodiment shown in the drawing, the engagement member used for extracting the castings 4, 5, 6 etc. from the moulds 1, 2, 3 etc. is constituted by a hook 14 capable of engaging an upstream surface just behind the edge of each casting. In another embodiment (not shown), the engagement member is constituted by a more or less straight or smooth "finger" merely jerking or prodding the casting loose from the mould.

In a further embodiment (also not shown), the engagement member is constituted by a suction cup of a shape complementary to that of the casting, connectable to a suitable vacuum source, capable of both pulling the casting out of the casting cavity and (if required) holding it until it can be deposited gently on e.g. a conveyor.

In a still further embodiment (also not shown), the engagement member is constituted by an electromagnet connectable to a suitable source of electric current. This embodiment will function in the same manner as the embodiment mentioned in the previous paragraph, but its use is—necessarily—limited to castings consisting of ferromagnetic material having a temperature below the Curie point. In this case, the requisite cooling could be achieved by increasing the length of the part of the mould string extending from the pouring station (not shown) to the extraction station 8.

LIST OF PARTS

1 downstream-most mould
2 mould
3 mould
4 casting
5 casting
6 casting
7 bar
8 extraction station
9 robot gripper
10 frame
11 upper pressure pad
12 lateral pressure pad
13 lifting bar
14 engagement hook
15 conveyor

What is claimed is:

1. Method of extracting castings from casting cavities in moulds being advanced in a string of moulds, in which the casting cavities are defined by surfaces in each mould and oppositely facing surfaces in preceding and succeeding moulds, respectively, characterized by the following steps a–d inclusive:

a) the downstream-most mould is gripped by a robot gripper engaging at least its lateral faces extending in the direction of advancement of said string of moulds, b) said downstream-most mould is moved using said robot to an extraction station comprising at least one engagement member, c) said engagement member or members is/are brought into engagement with said casting, all by suitable relative movement of said downstream-most mould and said engagement member or members, and d) said engagement member or members and said downstream-most mould are moved relative to each other in a manner to disengage said casting from said mould.

2. Method according to claim 1, characterized in that in step c said engagement member or members is/are brought to penetrate into the material of said downstream-most mould at a point or points adjacent the casting or a part of same.

3. Method according to claim 1, characterized by the use of at least one hook-shaped engagement member engaging a surface facing upstream on said casting.

4. Method according to claim 1, characterized in that the weight of said downstream-most mould and any casting carried by said downstream-most mould is supported by said robot during at least steps a, b, c.

5. Method according to claim 1, characterized by the use of at least two engagement members cooperating with each other to hold said casting during and after said disengagement from said downstream-most mould, and at least until the casting has been moved using said members into a position, said casting capable of being released from the engagement members without falling in a way to cause damage to it.

6. Method according to claim 1, characterized by the use of at least one engagement member adapted to engage a casting by suction, said engagement member comprising an open cavity bounded by circumferential sealing member adapted to provide a fluid-tight seal with a corresponding surface of the casting, said cavity being connectable to a source of sub-atmospheric pressure.

7. Method according to claim 1, characterized by the use of at least one engagement member adapted to engage a casting by magnetic attraction, said engagement member comprising an electromagnet electrically connectable to a source of electrical current.

8. Method according to claim 1, characterized by the use of a robot comprising a substantially horizontal supporting surface, said supporting surface being placed in continuation of the surface supporting said string of moulds, after which the latter is advanced one step forward so as to place said downstream-most mould supported on said substantially horizontal supporting surface comprised by said robot.

9. Method according to claim 1 and in which at least said downstream-most mould is supported on spaced first bars extending in the direction of advancement of said string of mould, characterized by the use of a robot comprising spaced second bars adapted to be moved into the spaces between said first bars and to lift said downstream-most mould from the latter.

10. Method according to claim 1, characterized in that the relative movement between said robot gripper and said engagement member or members is produced by moving the robot gripper and keeping the engagement member or members stationary.

11. Method according to claim 1, characterized by the use of moulds and at least one casting, in which each casting cavity is divided between an upstream mould and a downstream mould in such a manner, that the resistance of each casting against being disengaged is greatest relative to the upstream mould, so that the casting will remain in the downstream mould upon separation of the two moulds concerned.

12. An automatic foundry plant for carrying out the method according to claim 1 and of the kind comprising:

a) stationary supporting or conveying means for advancing a string of moulds comprising casting cavities defined by surfaces in each mould and oppositely facing surfaces in preceding and succeeding moulds, respectively, in a state in which said casting cavities are occupied by castings in a solid sate, and (b) extracting means adapted to separate said castings from said moulds, characterized in (c) that said extracting means comprise c1) a robot gripper adapted to grip and carry at least the downstream-most mould by engaging at least the latter's lateral faces extending in the direction of advancement of said string of moulds, and c2) at least one engagement member capable of engaging the casting of said downstream-most mould, said robot gripper and said engagement member or members being adapted for mutual relative movement.

13. The plant according to claim 12, characterized by at least one hook-shaped engagement member adapted to engage a surface facing upstream on said casting.

14. The plant according to claim 12, characterized by at least one engagement member adapted to engage a casting by suction, said engagement member comprising an open cavity bounded by a circumferential sealing member adapted to provide a fluid-tight seal with a corresponding surface of the casting, said cavity being connectable to a source of sub-atmospheric pressure.

15. The plant according to claim 12 characterized by at least one engagement member adapted to engage a casting by magnetic attraction, said engagement member comprising an electromagnetic electrically connectable to a source of electrical current.

16. The plant according to claim 12 characterized in that said robot gripper comprises supporting means capable of supporting the weight of at least said downstream-most mould and any casting carried by said downstream-most mould.

17. The plant according to claim 16 and in which said stationary supporting or conveying means comprises spaced first bars extending in the direction of advancement of said string of moulds, characterized in that said robot supporting means comprise spaced second bars capable of being moved into the spaces between said first bars and upwardly away from said spaces.

18. The plant according to claim 12 for carrying out the method according to any one or any of the claims 3–11, characterized by at least two engagement members adapted to cooperate with each other, to temporarily hold said casting.

* * * * *